US008113200B2

(12) United States Patent
Davis

(10) Patent No.: US 8,113,200 B2
(45) Date of Patent: Feb. 14, 2012

(54) RESPIRATOR MASK WITH CORRECTIVE LENS FRAME ASSEMBLY

(75) Inventor: Brian E. Davis, Bratton (GB)

(73) Assignee: Avon Protection Systems, Inc., Cadillac, MI (US)

( * ) Notice: Subject to any disclaimer, the term of this patent is extended or adjusted under 35 U.S.C. 154(b) by 1116 days.

(21) Appl. No.: 11/913,382

(22) PCT Filed: May 4, 2006

(86) PCT No.: PCT/US2006/017072

§ 371 (c)(1),
(2), (4) Date: Nov. 1, 2007

(87) PCT Pub. No.: WO2007/040634

PCT Pub. Date: Apr. 12, 2007

(65) Prior Publication Data

US 2008/0186447 A1 Aug. 7, 2008

Related U.S. Application Data

(60) Provisional application No. 60/677,509, filed on May 4, 2005.

(51) Int. Cl.

| | |
|---|---|
| ***A62B 17/04*** | (2006.01) |
| ***A62B 18/02*** | (2006.01) |
| ***A62B 18/08*** | (2006.01) |
| ***A62B 7/10*** | (2006.01) |
| ***A61F 11/00*** | (2006.01) |
| ***A42B 1/06*** | (2006.01) |
| ***A42B 1/22*** | (2006.01) |
| ***A42B 7/00*** | (2006.01) |
| ***A42B 1/08*** | (2006.01) |
| ***F41H 1/04*** | (2006.01) |
| ***G02C 1/00*** | (2006.01) |

(52) U.S. Cl. ..... 128/205.25; 128/201.22; 128/201.23; 128/201.24; 128/206.21; 128/206.24; 128/206.23; 128/205.27; 128/206.13; 128/866; 128/868; 2/410; 2/6.2; 2/6.3; 2/417; 2/421; 2/423; 2/424; 2/909; 2/15; 351/158

(58) Field of Classification Search ..... 128/201.22, 128/201.23, 201.24, 206.21, 206.24, 206.23, 128/205.27, 206.13, 866, 868; 2/410, 6.2, 2/6.3, 417, 421, 423, 424, 15, 909; 351/158
See application file for complete search history.

(56) References Cited

U.S. PATENT DOCUMENTS 2,396,207 A 3/1946 Schutz
(Continued)

FOREIGN PATENT DOCUMENTS

BE 1013165 A6 10/2001
(Continued)

*Primary Examiner* — Patricia Bianco
*Assistant Examiner* — Nihir Patel
(74) *Attorney, Agent, or Firm* — McGarry Bair PC

(57) ABSTRACT

A respirator mask has a removably mounted support frame that adjustably and removably mounts a corrective lens frame. The corrective lens frame further has a molded bridge with a biasing member embedded therein. A pivotal tab on the support frame is received in one of a plurality of detents on the lens frame for releasably securing the lens frame in the desired position on the support frame. Laterally disposed mounting lugs on the support frame are received in integrally molded pockets in the respirator mask.

15 Claims, 7 Drawing Sheets

U.S. PATENT DOCUMENTS

| | | | | | |
|---|---|---|---|---|---|
| 2,737,659 | A | | 3/1956 | Glidden | |
| 2,905,172 | A | | 9/1959 | Rodenhouse | |
| 3,004,535 | A | | 10/1961 | Nielson | |
| 3,146,295 | A | | 8/1964 | Roland | |
| 3,563,640 | A | | 2/1971 | Wise | |
| 4,349,251 | A | | 9/1982 | Shedrow | |
| 4,542,965 | A | * | 9/1985 | Shedrow | 351/57 |
| 4,709,696 | A | | 12/1987 | Angell | |
| 4,711,539 | A | * | 12/1987 | Krusas et al. | 351/63 |
| 4,930,163 | A | | 6/1990 | King | |
| 6,019,468 | A | | 2/2000 | Altemare, Jr. | |
| 6,776,485 | B2 | | 8/2004 | Cole | |

FOREIGN PATENT DOCUMENTS

| | | | |
|---|---|---|---|
| DE | 1171750 | | 6/1964 |
| DE | 2646042 | A1 | 4/1978 |
| JP | 57200238 | | 12/1982 |
| JP | 62049866 | | 3/1987 |

* cited by examiner

RESPIRATOR MASK WITH CORRECTIVE LENS FRAME ASSEMBLY

CROSS-REFERENCE TO RELATED APPLICATIONS

This application claims priority on International Application No. PCT/US2006/017072, filed May 4, 2006, which claims the benefit of U.S. Provisional Patent Application No. 60/677,509, filed May 4, 2005, which is incorporated herein in by reference in its entirety.

BACKGROUND OF THE INVENTION

1. Field of the Invention

This invention relates to respirator masks. In one of its aspects, the invention relates to respirator masks with a removably mounted corrective lens support frame that is adapted to adjustably mount a corrective lens frame. In another of its aspects, the invention relates to respirator masks with an integral resiliently foldable corrective lens frame. In another of its aspects, the invention relates to respirator masks with a releasable lock to retain a corrective lens frame in adjusted position in the mask. In another of its aspects, the invention relates to respirator masks with a corrective lens support frame that is adapted to mount a corrective lens frame and that is securely retained in the mask.

2. Description of the Related Art

Respirator masks are devices commonly used by military personnel, firefighters, and industrial workers in hazardous environments for protection from inhalation of harmful substances including smoke, chemicals, and biological agents. These respirator masks may employ a filtration system to purify air before it is inhaled by a wearer and thus an air-tight seal between the mask and the wearer's face is crucial during its utilization in a dangerous environment.

Vision correction is necessary for many individuals, including those with an occupation that may require occasional use of a respirator mask, and is a well-known problem in the art. Conventional eye glasses cannot be worn with respirator masks because of lack of space within the mask and the possibility of spectacle side arms jeopardizing the necessarily tight fit of the mask. Contact lenses are an alternate vision correction means, but allergies and other medical conditions may not permit the use of contact lenses for some individuals. Contact lenses are also problematic as these lenses may become polluted with environmental contaminants such as smoke or chemicals, thereby causing problems for the user.

Thus, respirator masks with vision correction lens assemblies to be used by an individual wearing a mask have been developed. Any vision correction assembly must be installed within the mask in order to maintain the air-tight seal needed for the mask to function properly. Since these masks are often used in critical situations, it is also essential that the lenses stay in the correct position during operational use. It is also advantageous to allow for adjustment of the lens position within the mask to accommodate different individuals and also for the assembly to be interchangeable for different prescriptions and removable for those not needing vision correction. It is also desirous for a respirator mask, and subsequently any for any mask insert to be foldable to allow easy handling, transport and retention of fit.

Many such assemblies have been proposed to provide vision correction within a respirator mask, some of which are discussed herein. U.S. Pat. No. 6,019,468 to Altemare, Jr. discloses a spectacle kit having a protective mask insert clip and detachable means for attaching a spectacle front piece firmly to the protective mask insert, by snapping the receiver onto an insert clip. The front piece includes notch attachments for optionally mounting a head strap to the front piece so that the front piece can be worn separately from the mask.

A device for holding spectacles in a mask is disclosed in U.S. Pat. No. 3,563,640 to Wise. The device comprises a spring wire with a wire loop that slidably supports a friction member attached to a spectacles frame. The friction member is vertically adjustable on the wire loop to adjust the vertical position of the spectacles frame. The spring wire is mounted against a window of the mask and is retained in position by spring force thereof.

U.S. Pat. No. 3,004,525 to Nielson discloses a gas mask with an optical insert comprising a nose piece and spectacle frames that are flexible so that the optical insert can be folded onto itself. The optical insert is mounted to the gas mask through a strap having a tip integrally molded to the mask and sized so that the optical insert can be snap fit thereto. The strap forms a loop that can be adjusted to change the position of the optical insert in the gas mask.

A support structure for a protective mask optical insert comprising a pair of hinged eyewires sized to hold corrective lenses is disclosed in U.S. Pat. No. 4,711,539 to Krusas. The eyewires can fold at the hinge onto one another and are biased apart by a pair of torsion springs. The optical insert is mounted to a front hinge block, which is vertically adjustable relative to a back block. An anchor mounted to a structural element located between the face plates of the mask supports the back block and thereby the optical insert inside the face mask.

SUMMARY OF THE INVENTION

A respirator mask according to the invention comprises a face piece adapted to fit on the face of a user and having an opening at a front portion thereof, a visor mounted in the opening for viewing by a mask user, a corrective lens support frame removably mounted to the face piece behind the visor, and a corrective lens frame adjustably mounted on the corrective lens support frame.

According to one embodiment of the invention, the corrective lens frame has an insert molded bridge having a biasing member embedded therein for resiliently flexing the sides of the frame about a central portion thereof.

According to another embodiment of the invention, the corrective lens support frame has a shape that conforms to the shape of the visor.

According to yet another embodiment of the invention, the support frame has a generally vertical central bridge connecting upper and lower portions of the support frame and has a plurality of generally horizontal detents on the rear of the bridge that mate with a projection on the corrective lens frame for adjustably securing the corrective lens frame in a desired vertical position on the support frame.

According to still another embodiment of the invention, the support frame further includes mounting lugs formed on either side of the frame, wherein each of the mounting lugs has spaced projections that are received in pockets on the inner side of the face piece.

In another embodiment of the invention, the support frame further has a hole in the central bridge, the inner side of the face piece has a protuberance positioned above the visor, and the protuberance is received within the hole in the bridge for partially mounting the support frame on the face piece.

In a further embodiment of the invention, the projection is formed on a pivotally mounted locking tab that is movable between locking and unlocking engagement with the central bridge of the support frame.

In yet another embodiment of the invention, the corrective lens frame has a central piece that includes a pair of opposed arms that wrap around a central bridge of the support frame to slidably mount the corrective lens frame to the support frame.

In still another embodiment of the invention, the corrective lens frame has a pivotally mounted locking tab that is movable between locking and unlocking engagement with a central bridge of the support frame for adjustably securing the corrective lens frame in a desired vertical position on the support frame.

DESCRIPTION OF THE PREFERRED EMBODIMENT

Figure 1:
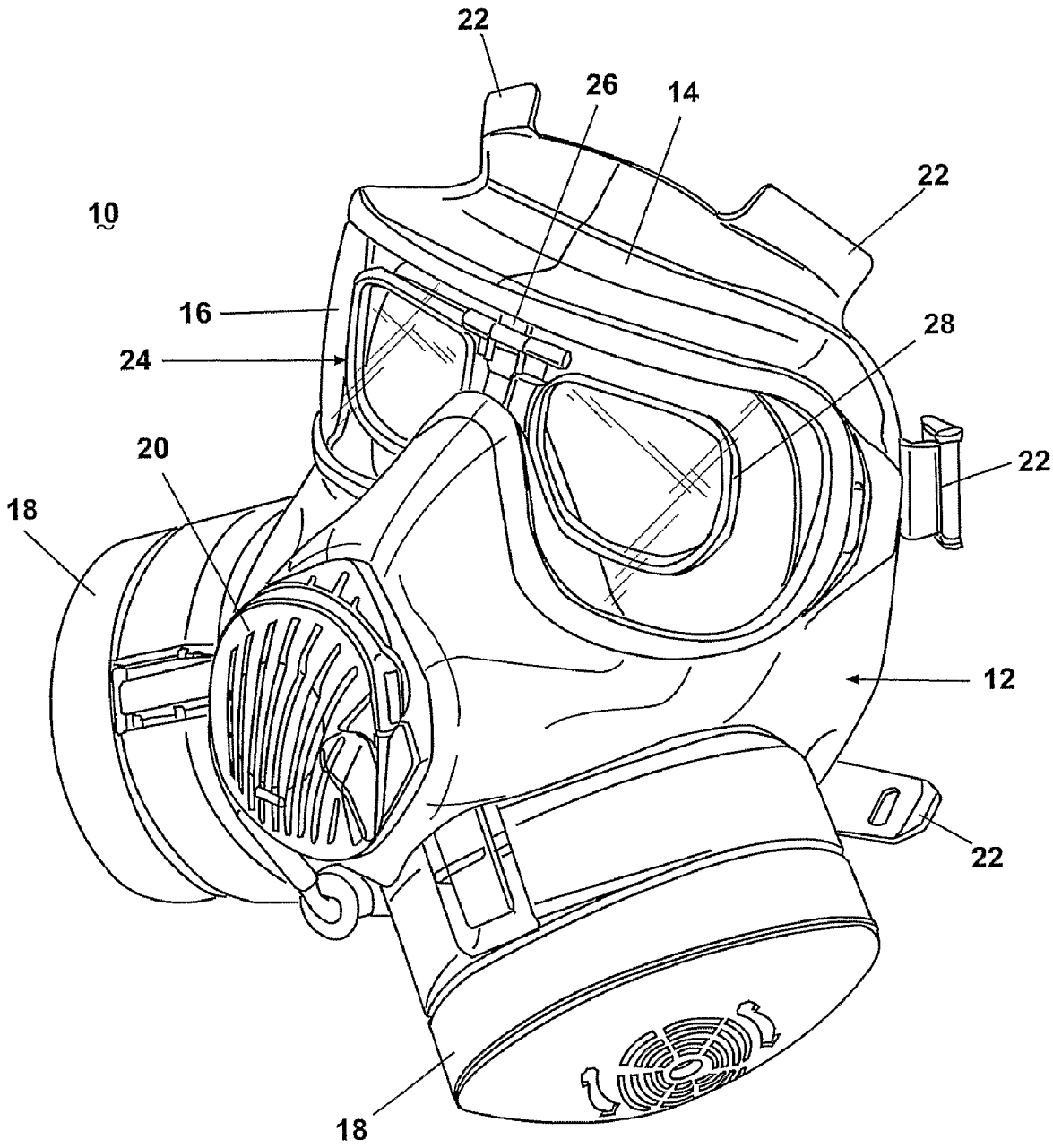
FIG. 1 is a perspective view of the respirator mask equipped with a removable corrective lens insert according to the invention.

Referring now to the drawings and specifically to FIG. 1, a respirator mask assembly 10 according to the invention comprises a mask 12, having a facepiece 14 that fits over the face of a user, a transparent visor 16, a pair of circular or elliptical canister filters 18, and a front module 20 for speech transmission and exhalation functions. The mask is held to the face of the user by a plurality of harness strap attachments 22 on the periphery of the mask 12. A corrective lens insert 24 is mounted behind the visor 16 and comprises a support frame 26, the shape of which conforms to the shape of the visor 16 and a lens frame 28 mounted to the support frame 26.

Figure 2:
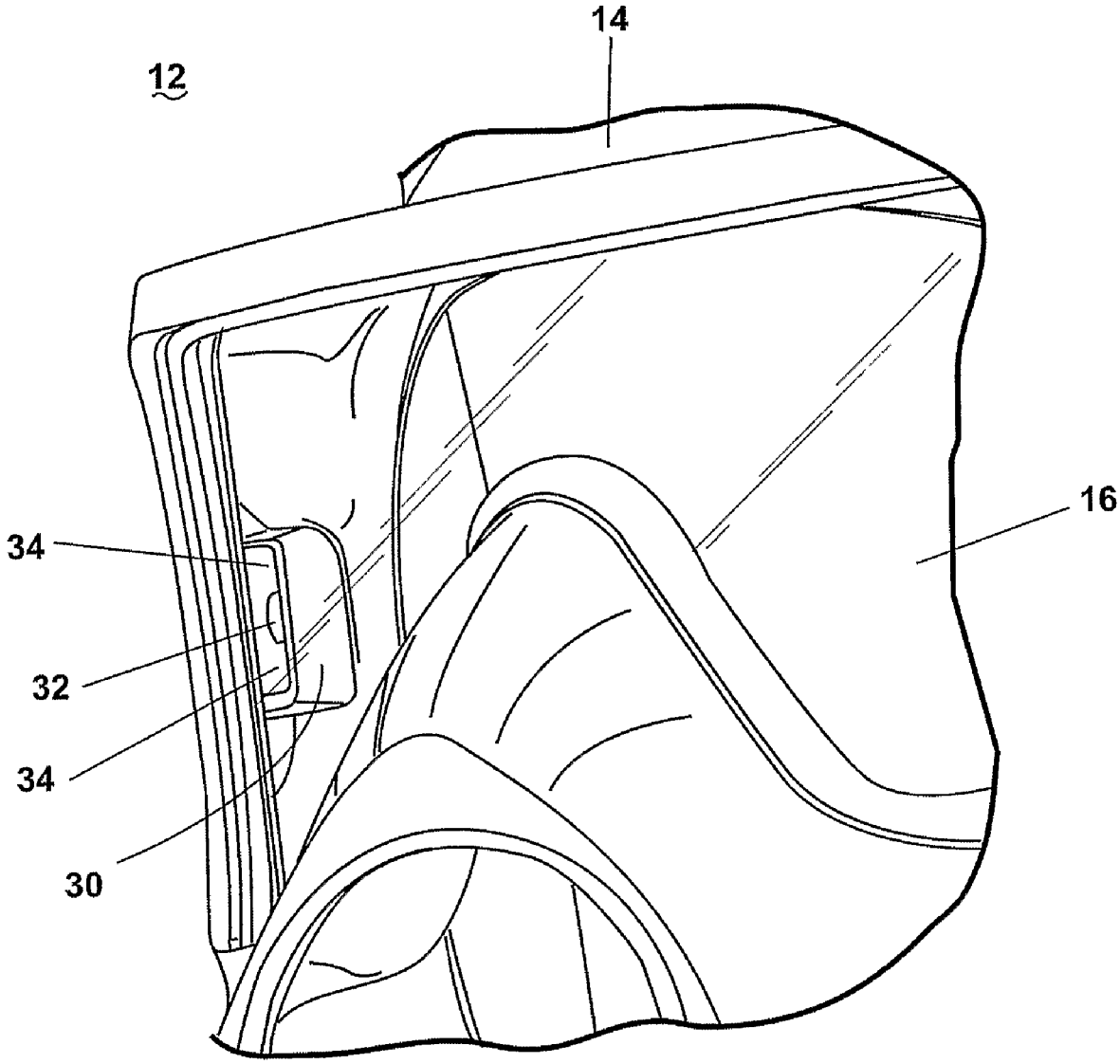
FIG. 2 is an enlarged perspective view of a portion of the respirator mask of FIG. 1 without the corrective lens insert, and showing an insertion pocket.

Referring to FIG. 2, a pocket 30 is integrally molded on the inner side of the mask 12 and projects forwardly toward the visor 16 from the facepiece 14. The pocket 30 has a relatively horizontal partition 32 that creates two separate slots 34 for receiving the support frame 26.

Figure 3:
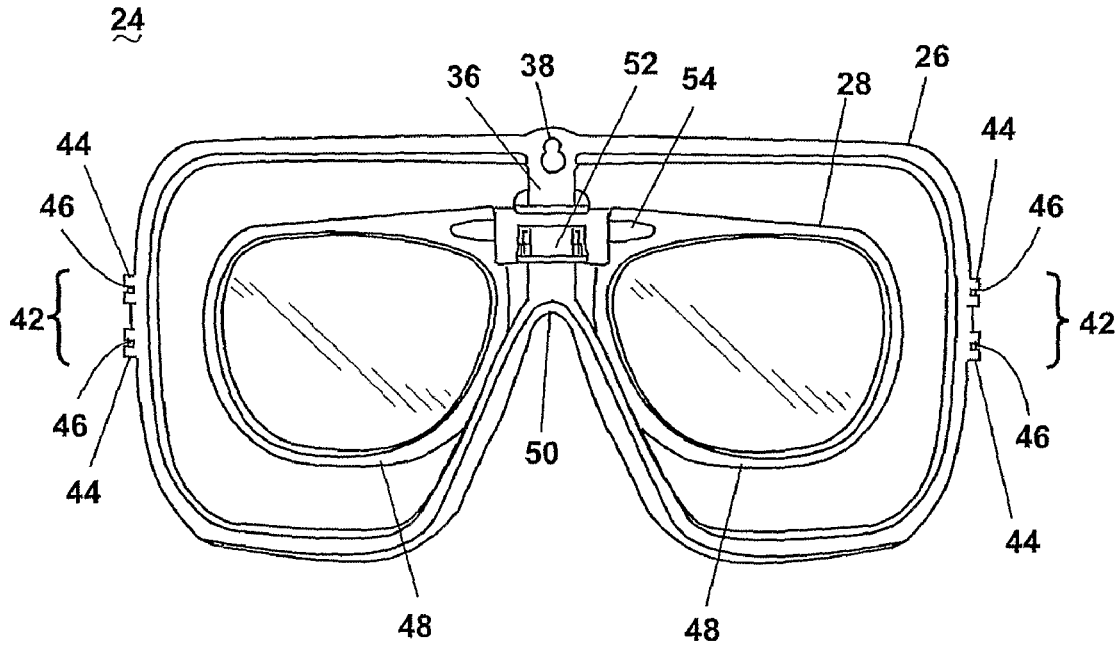
FIG. 3 is a front view of the corrective lens insert shown in FIG. 1 and comprising a support frame and a corrective lens frame.
Figure 4:
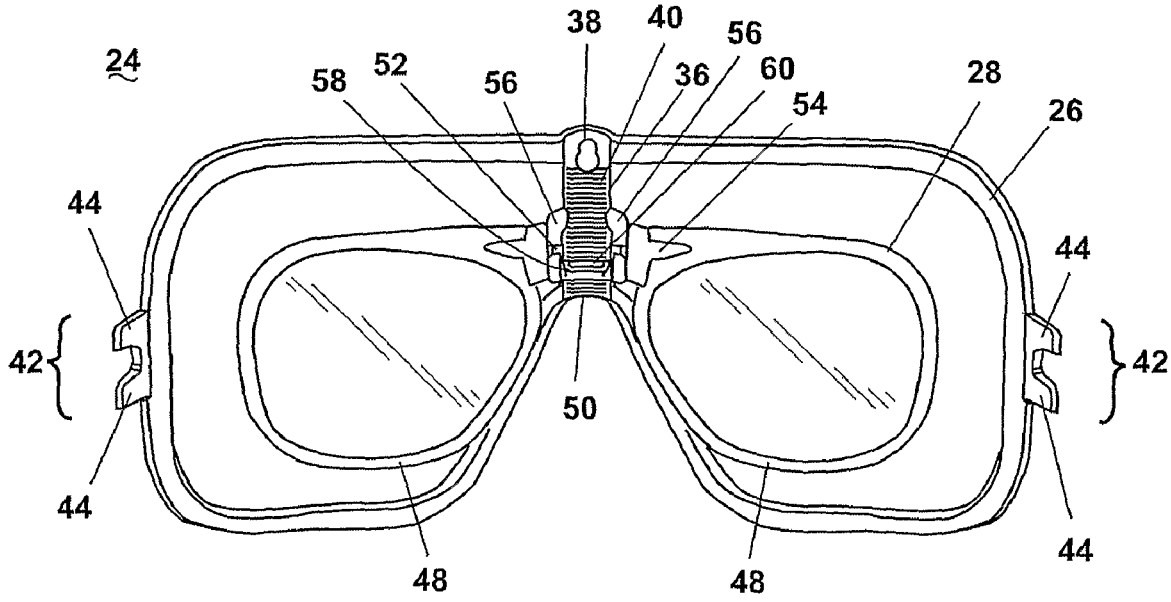
FIG. 4 is a rear view of the corrective lens insert shown in FIG. 3, with a tab in an open position.

Referring now to FIGS. 3 and 4, the support frame 26 comprises a generally vertical central bridge 36 connecting upper and lower portions of the frame 26 having a key hole-shaped slot 38 disposed at the upper joint of the bridge, a plurality of horizontal detents 40 on the rear side thereof, and mounting lugs 42 projecting from the generally vertical sides on the frame 26. The support frame 26 is preferably made of a flexible material so that it may be folded in half and is slightly convex so that the lugs 42 point generally rearward. The mounting lugs 42 comprise U-shaped spaced projections 44 having ramp-like spines 46 that protrude horizontally and laterally from the outer side of the support frame 26.

The lens frame 28 comprises a pair of relatively rigid lens holders 48 joined by a generally horizontal bridge portion 50. The bridge portion 50 is formed by a relatively rigid central piece 52 connected between the lens holders 48 by an insert molded hinge 54 that spans both sides of the central piece 52. The hinge 54 is flexible so that the lens holders 48 can be folded onto one another. A biasing member in the form of a metal spring 80 (FIG. 5) embedded in the hinge 54 biases the lens holders 48 to the position illustrated in the drawings. The central piece 52 includes a pair of opposed arms 56 that wrap around the central bridge 36 of the support frame 26. The central piece 26 further has a pair of channels 64 that have an angled portion 66 and a catch portion 68 molded on the central piece 52 of the lens frame 28. A pivotal tab 58 has multiple horizontal braces 60 projecting from one side, which are sized to mate with the detents 40 on the central bridge 36. The tab 58 has a dowel 62 mounted at one end and a narrowed end 78.

Figure 5:
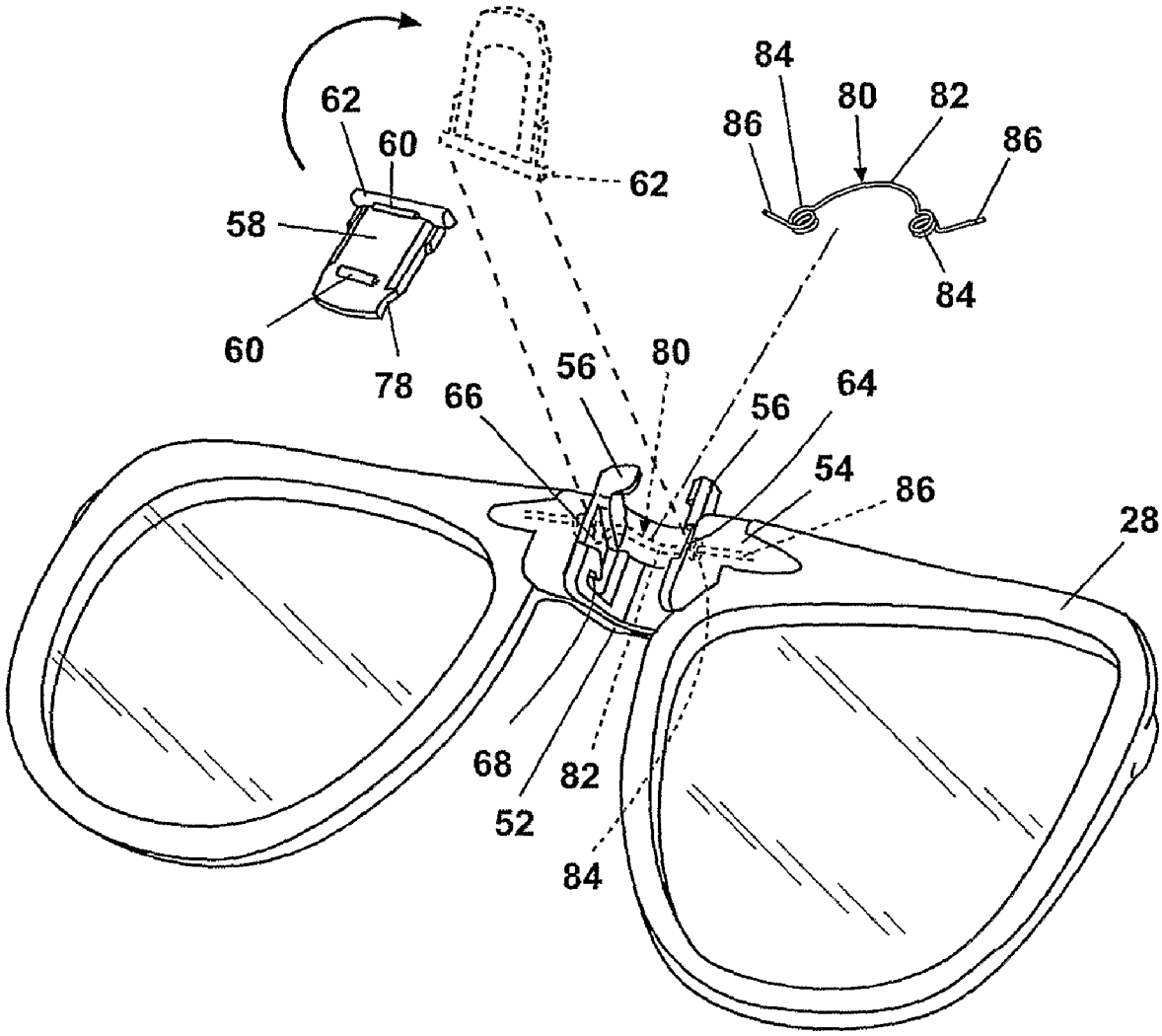
FIG. 5 is a rear exploded view of the corrective lens frame, showing the insertion of the tab in the corrective lens frame.

Referring now to FIG. 5, the metal spring 80 and the tab 58 are shown exploded from the lens frame 28. The spring 80 is formed from a single piece of thin metal wire that has a central arc 82 with coils 84 on either end of arc 82 and leaving straight ends 86 that extend relatively horizontally to the lens holders 48. The ends of the dowell 62 are adapted and shaped to fit into the channels 64.

To assemble the corrective lens insert 24, the central bridge 36 of the support frame 26 is pressed against the central piece 52 of the lens frame 28 so that arms 56 wrap around the central bridge 36. The dowel 62 of the pivotal tab 58 is then fit into the angled portion 66 of the channels 64 and pushed downwardly and inwardly until it is secured behind the catch 68. The tab 58 is pivotally retained by the catch portion 68 and can pivot around the central axis of the dowel 62. The tab 58 narrowed end 78 is shaped to fit tightly between anus 56 when the tab 58 is pivoted upward.

Figure 6:
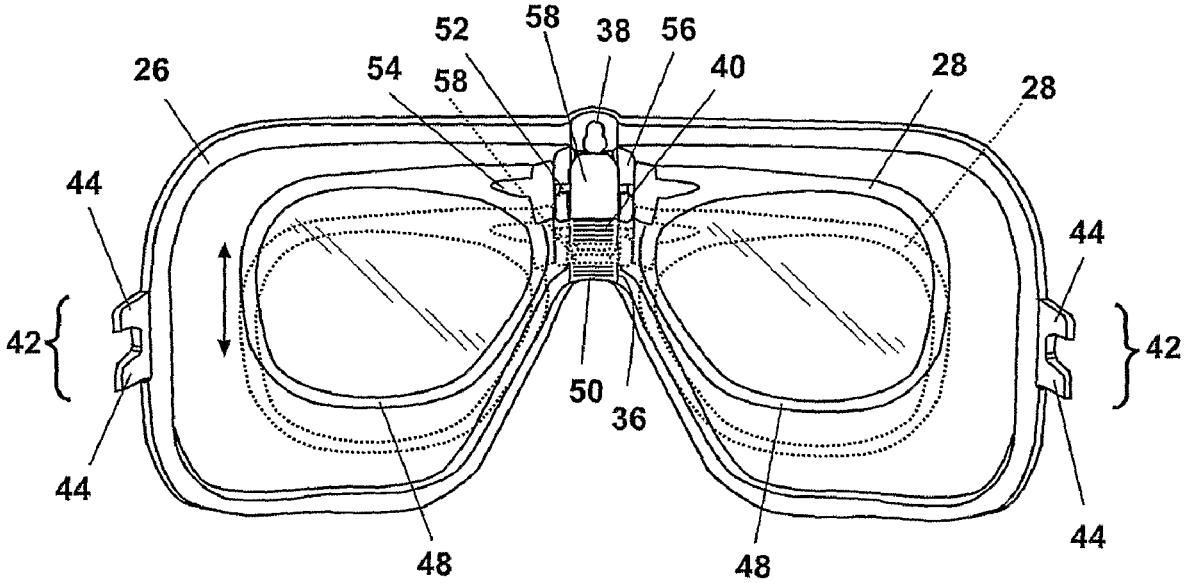
FIG. 6 is a rear view similar to FIG. 4 showing the vertical adjustment mechanism of the corrective lens frame with respect to the insert, and with the tab in the closed position.

Referring now to FIG. 6, the lens frame 28 is vertically adjustable relative to the support frame 26. The central piece 52 is slid along the central bridge 36 with the pivotal tab 58 in an open position illustrated in FIG. 4. When the lens frame 28 is in a desired position, the tab 58 is pivoted upwards and towards the central piece 52 about the dowel 62 and snapped thereto so that the braces 60 engage the detents 40 and the narrowed end 78 is press-fitted between the arms 56, thereby securing the lens frame 28 at the desired vertical position.

Figure 7:
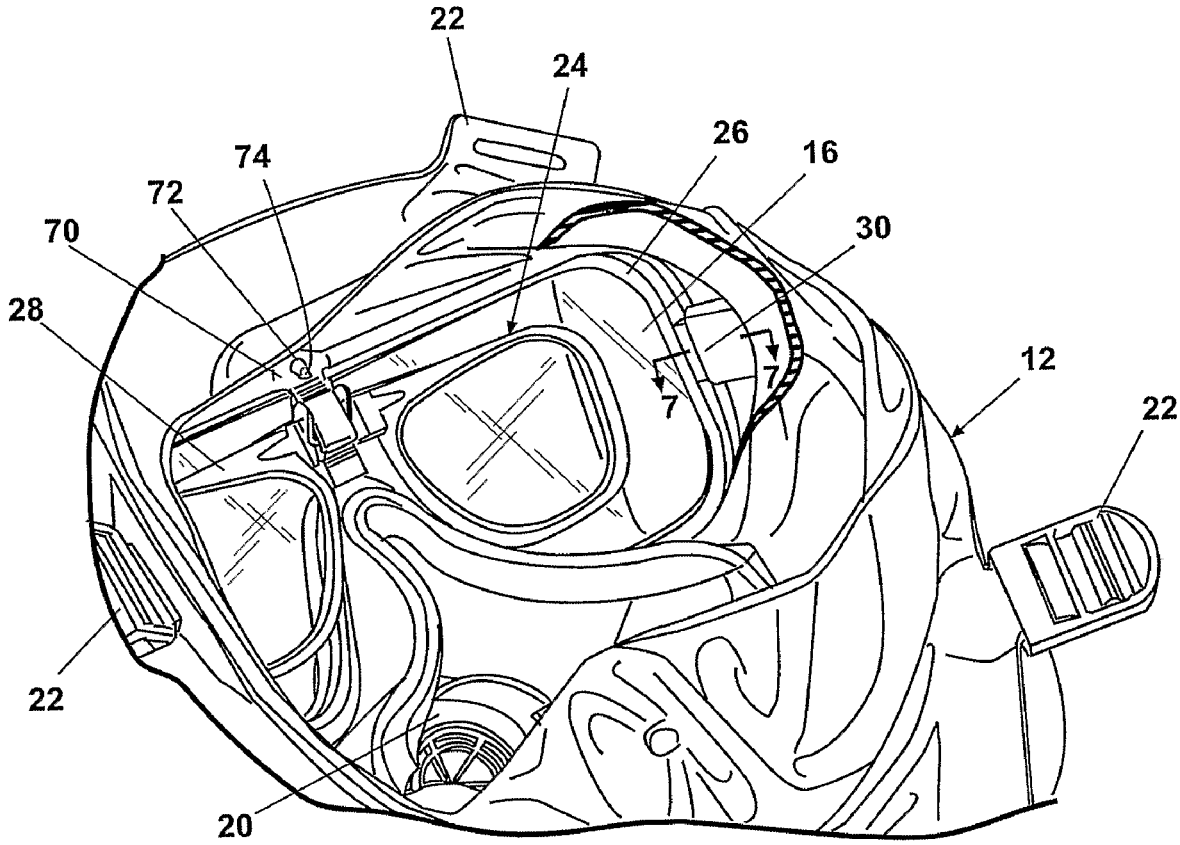
FIG. 7 is a partial rear perspective view of the respirator mask and removable corrective lens insert shown in FIG. 1 with part of the respirator mask removed to show the insertion pocket.

Referring now to FIG. 7, the corrective lens insert 24 is shown attached within the mask 12, wherein the key hole slot 38 in the support frame 26 is fitted to a protuberance 70 projecting from the mask 12 above the visor 16. The protuberance 70 has a circular head 72 and a cylindrical stem 74 wherein the head 72 is of slightly greater diameter than the stem 74. The head 72 is inserted through the larger portion of the key hole slot 38 and the support frame 26 is pushed downward so that the stem 74 engages the smaller portion of the key hole slot 38, thereby locking the support frame 26 in place in the mask. The mounting lugs 42 (FIG. 4) are inserted into pockets 30 located on both sides of the visor 16.

Figure 8:
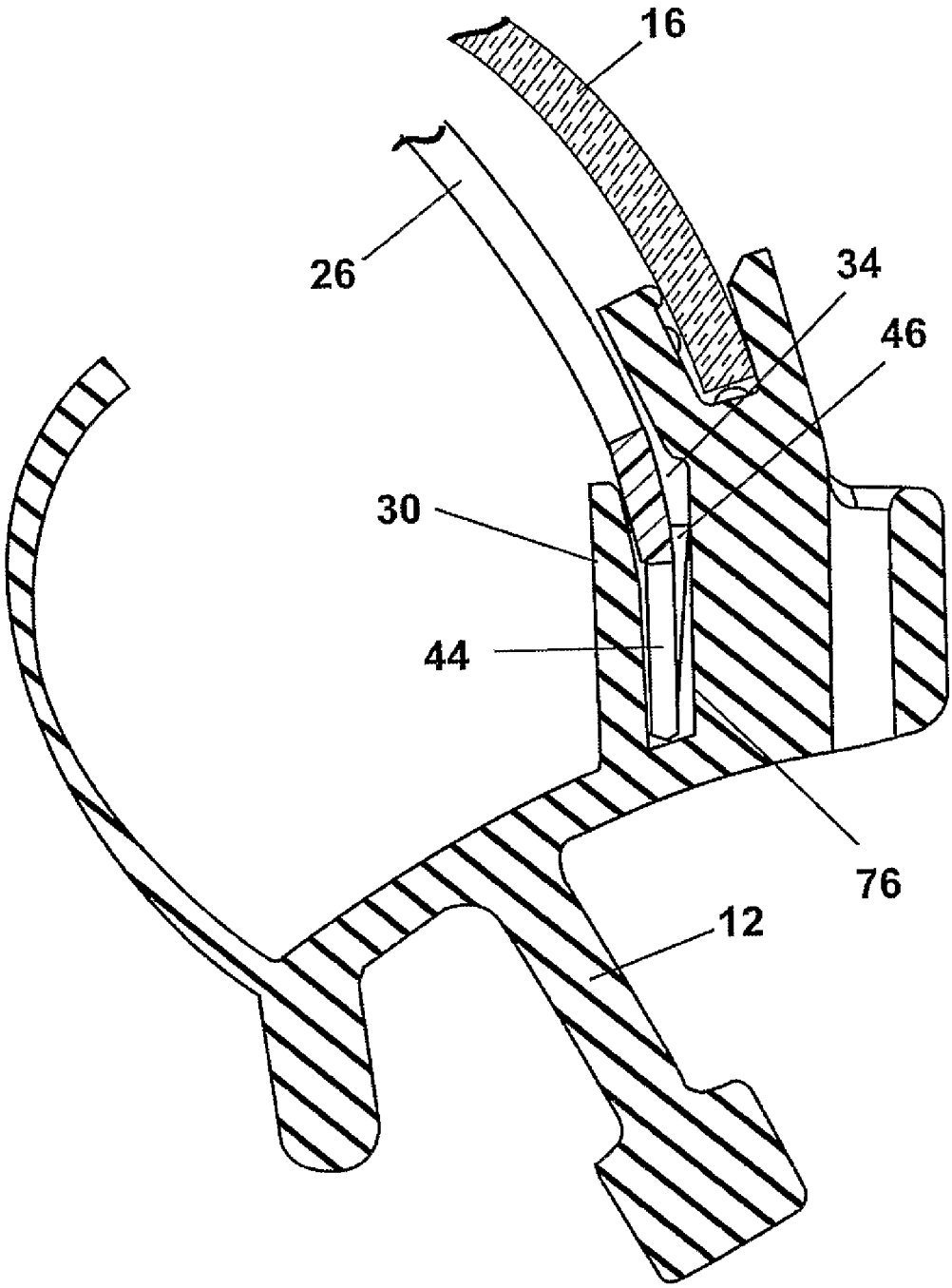
FIG. 8 is a sectional view taken along line 7-7 of FIG. 7 showing a portion of the respirator mask and removable corrective lens insert.

Referring to FIG. 8, the spaced projections 44 of the support frame 26 are received in the slots 34 of the pocket 30 for further attachment of the corrective lens insert 24 to the respirator mask 12. The spines 46 on the projections 44 of the mounting lugs 42 bear against a wall 76 of the pocket 30 and releasably retain the corrective lens insert 24 behind the visor 16 of the respirator mask 12.

While the invention has been specifically described in connection with certain specific embodiments thereof, it is to be understood that this is by way of illustration and not of limitation, and the scope of the appended claims should be construed as broadly as the prior art will permit.

What is claimed is:

1. A respirator mask having a face piece adapted to fit on the face of a user and having an opening at a front portion thereof; a visor mounted in the opening for viewing by a mask user; a corrective lens support frame removably mounted to the face piece behind the visor; and a corrective lens frame adjustably mounted on the corrective lens support frame and that has a shape that conforms to the shape of the visor; wherein the corrective lens frame has a pair of relatively rigid lens holders joined by bridge portion that includes an insert molded hinge having a biasing member embedded therein for resiliently flexing the lens holders of the corrective lens frame about a central portion thereof.

2. A respirator mask having a face piece adapted to fit on the face of a user and having an opening at a front portion thereof; a visor mounted in the opening for viewing by a mask user; a corrective lens support frame removably mounted to the face piece behind the visor; and a corrective lens frame adjustably mounted on the corrective lens support frame; wherein the corrective lens frame has a pair of relatively rigid lens holders joined by a bridge portion that includes an insert molded hinge having a biasing member embedded therein for resiliently flexing the lens holders of the corrective lens frame about a central portion thereof; wherein the support frame has a generally vertical central bridge connecting upper and lower portions of the support frame and has a plurality of generally horizontal detents on the rear of the bridge that mate with a projection on the corrective lens frame for adjustably securing the corrective lens frame in a desired vertical position on the support frame.

3. The respirator mask according to claim 2 wherein the support frame further includes mounting lugs formed on either side of the frame, wherein each of the mounting lugs has spaced projections that are received in pockets on the inner side of the face piece.

4. The respirator mask according to claim 3 wherein the support frame further has a hole in the central bridge; the inner side of the face piece has a protuberance positioned above the visor; and the protuberance is received within the hole in the bridge for partially mounting the support frame on the face piece.

5. The respirator mask according to claim 2 wherein the projection is formed on a pivotally mounted locking tab that is movable between locking and unlocking engagement with the central bridge of the support frame.

6. A respirator mask having a face piece adapted to fit on the face of a user and having an opening at a front portion thereof; a visor mounted in the opening for viewing by a mask user; a corrective lens support frame removably mounted to the face piece behind the visor; and a corrective lens frame adjustably mounted on the corrective lens support frame; wherein the corrective lens frame has a pair of relatively rigid lens holders joined by a bridge portion that includes an insert molded hinge having a biasing member embedded therein for resiliently flexing the lens holders of the corrective lens frame about a central portion thereof; wherein the corrective lens frame has a central piece that includes a pair of opposed arms that wrap around a central bridge of the support frame to slidably mount the corrective lens frame to the support frame.

7. A respirator mask having a face piece adapted to fit on the face of a user and having an opening at a front portion thereof; a visor mounted in the opening for viewing by a mask user; a corrective lens support frame removably mounted to the face piece behind the visor; and a corrective lens frame adjustably mounted on the corrective lens support frame; wherein the corrective lens frame has a pair of relatively rigid lens holders joined by a bridge portion that includes an insert molded hinge having a biasing member embedded therein for resiliently flexing the lens holders of the corrective lens frame about a central portion thereof; wherein the corrective lens frame has a pivotally mounted locking tab that is movable between locking and unlocking engagement with a central bridge of the support frame for adjustably securing the corrective lens frame in a desired vertical position on the support frame.

8. A respirator mask having a face piece adapted to fit on the face of a user and having an opening at a front portion thereof; a visor mounted in the opening for viewing by a mask user; a corrective lens support frame removably mounted to the face piece behind the visor; and a corrective lens frame adjustably mounted on the corrective lens support frame; wherein the support frame has a generally vertical central bridge connecting upper and lower portions of the support frame and has a plurality of generally horizontal detents on the rear of the bridge that mate with a projection on the corrective lens frame for adjustably securing the corrective lens frame in a desired vertical position on the support frame.

9. The respirator mask according to claim 8 wherein the projection is formed on a pivotally mounted locking tab that is movable between locking and unlocking engagement with the central bridge of the support frame.

10. A respirator mask having a face piece adapted to fit on the face of a user and having an opening at a front portion thereof; a visor mounted in the opening for viewing by a mask user; a corrective lens support frame removably mounted to the face piece behind the visor and that has a shape that conforms to the shape of the visor; and a corrective lens frame adjustably mounted on the corrective lens support frame; wherein the support frame further includes mounting lugs formed on either side of the frame, and wherein each of the mounting lugs has spaced projections that are received in pockets on the inner side of the face piece and on the outer sides of the visor.

11. The respirator mask according to claim 10 wherein the support frame further has a hole in the central bridge; the inner side of the face piece has a protuberance positioned above the visor; and the protuberance is received within the hole in the bridge for partially mounting the support frame on the face piece.

12. A respirator mask having a face piece adapted to fit on the face of a user and having an opening at a front portion thereof; a visor mounted in the opening for viewing by a mask user; a corrective lens support frame removably mounted to the face piece behind the visor; and a corrective lens frame adjustably mounted on the corrective lens support frame; wherein the corrective lens frame has a central piece that includes a pair of opposed arms that wrap around a central bridge of the support frame to slidably mount the corrective lens frame to the support frame.

13. The respirator mask according to claim 12 wherein the corrective lens frame has a pivotally mounted locking tab that is movable between locking and unlocking engagement with a central bridge of the support frame for adjustably securing the corrective lens frame in a desired vertical position on the support frame.

14. The respirator mask according to claim 13 wherein the support frame central bridge has a plurality of generally horizontal detents on the rear of the bridge that mate with a projection on the corrective lens frame for adjustably securing the corrective lens frame in a desired vertical position on the support frame.

15. The respirator mask according to claim 14 wherein the projection is formed on a pivotally mounted locking tab that is movable between locking and unlocking engagement with the central bridge of the support frame.

* * * * *